United States Patent [19]

Perkins

[11] 4,106,900

[45] Aug. 15, 1978

[54] PROCESS FOR RECYCLING TEXTILE WARP YARN SIZE

[75] Inventor: Warren S. Perkins, Auburn, Ala.

[73] Assignee: Auburn University Research Foundation, Auburn, Ala.

[21] Appl. No.: 760,278

[22] Filed: Jan. 18, 1977

[51] Int. Cl.[2] ..... D06L 1/14; D06M 9/00

[52] U.S. Cl. ..... 8/115.6; 8/115.7; 8/138; 252/8.6

[58] Field of Search ..... 8/138, 115.6, 115.7; 252/8.6

[56] References Cited

U.S. PATENT DOCUMENTS

| | | | |
|---|---|---|---|
| 3,841,833 | 10/1974 | Minkema et al. | 8/138 |
| 3,960,485 | 6/1976 | Fantl et al. | 8/138 |

*Primary Examiner*—John Kight, III

*Attorney, Agent, or Firm*—Ferris M. Stout

[57] ABSTRACT

A chemical, useful as a warp size, which is soluble in water at one temperature and insoluble at a different temperature, is applied to textile yarns in the process known as slashing. By manipulation of temperatures the chemical is reclaimed and recycled as a warp size. The water from the reclamation step may be recycled, or the water may be discharged with a minimum of waste treatment.

6 Claims, 5 Drawing Figures

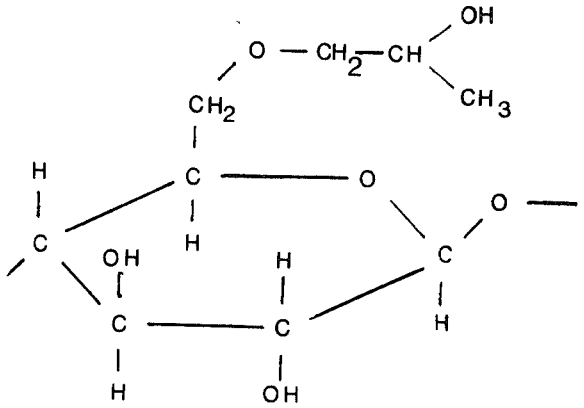
Hydroxypropylated polysaccharide unit
FIGURE 2
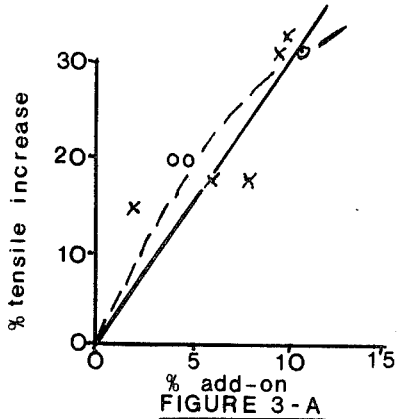
FIGURE 3-A
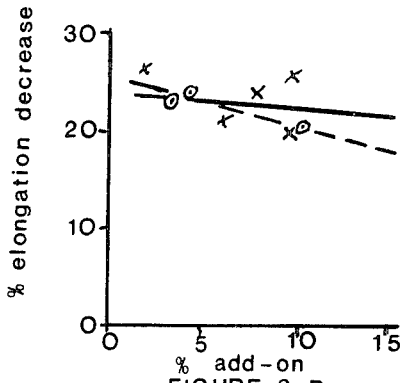
FIGURE 3-B
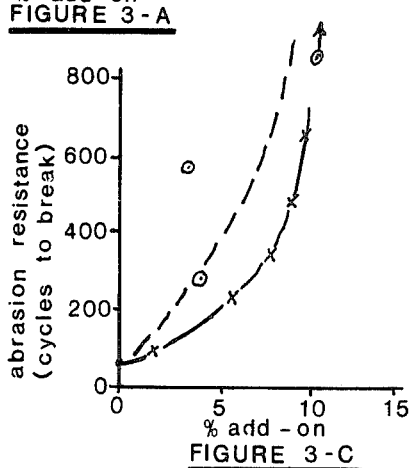
FIGURE 3-C
PVA* --o---o---
HPC —x——x——
*5% Griffwax (TM) added as lubricant

PROCESS FOR RECYCLING TEXTILE WARP YARN SIZE

The government has rights in this invention pursuant to Grant #R802,665 awarded by the United States Environmental Protection Administration.

BACKGROUND OF THE INVENTION

In textile terminology, the warp is the collection of lengthwise threads from which fabric is woven. That is to say, the warp is the thread which runs lengthwise of the loom. Typically, selected warp threads are raised by the heddles of the loom to allow the filling, or woof, to be carried between the alternate warp yarns. The alternate raising and lowering of the warps causes them to rub against one another, the rubbing causing abrasion of the threads. As they abrade, fine fibers are separated from the yarns, causing the yarns to cling together interfering with the passage of the shuttle. The warp yarns are also subjected to tensile and flexing forces which may cause them to break up during weaving.

This problem of abrasion of the warp in a loom has been dealt with by a process known as "slashing". When one slashes a warp, one applies to the warp threads a coating of size, which in effect glues loose fibrils to the body of the thread, and provides a degree of lubrication between the threads as they pass each other in the weaving operation. In early days of mechanized weaving, the sizing was applied to the warp on the loom by a man with a brush with a "slashing" motion. As modern high speed weaving was developed, the slashing step became a separate process. In the modern process, the warp is wound on a long mandrel called a "beam" in lengths of thousands of yards. Then the beam is unwound, the warp yarns being led through a machine called a "slasher". In the slasher, a solution of size material is applied to the threads. During slashing the yarns are passed over drying cylinders which remove the water and leave a coating of dry size on the yarn. The warp threads are separated one from another, and are rewound on another mandrel called the "loom beam". The loom beam itself is stored until a loom is ready to receive it for the weaving step.

In most cases, after a fabric has been woven, the warp size must be removed before the fabric is sent on to the finishing step, or to market. The step of removing the size is known as desizing. Typically, fabric from the loom is passed through a washing bath in which hot water dissolves the warp size. The cleaned fabric is dried and rewound. The wash water from the desizing bath, with its load of size washed out of the fabric, commonly must be treated before it is dumped into a nearby stream. Typical warp size is an organic material which, unless it is processed in a waste water treatment facility, will decompose in the stream, and rob the stream of dissolved oxygen, thereby creating a source of pollution. In technical language, the size creates "BOD" — biological oxygen demand. The effluent from a large textile mill is therefore potentially a major source of stream pollution.

As a consequence of antipollution legislation, textile mills have been obliged to install expensive waste-treating plants, or else they have had to resort to special, and expensive, warp-sizing processes which are non-polluting to both air and water.

The substance most commonly used for a warp size is starch, which may be derived from any of several sources. The starch is first cooked, or gelatinized, which converts the starch into a viscous hydrophilic substance which will adhere to fibers of the warp threads, on which it is subsequently dried, and from which it can be readily removed, in the desizing step, in a hot water wash. The starch size may be modified by the addition of certain adjuncts as lubricants. The starch may be chemically modified to enhance certain of its properties. For example, the starch may be reacted with nitrogen-containing radicals to render the starch "soluble" in the sense that the starch can be readily dissolved in water and its gelatinous, viscous state, produced without previously cooking it. Although starch, and various modifications to it, makes a cheap and useful warp size, it cannot be reclaimed in the desizing step. The process of removing the starch from the woven fabric typically involves depolymerization of the starch with enzymes or other agents followed by washing away of the degradation products with water. The starch degradation products in the wash water are, of course, a total loss to the mill. Moreover, the wash water can no longer be discharged into a stream, as pointed out above, and therefore its disposal constitutes a major expense in the operation of the textile mill.

The disposal of desize wash water has become so great a problem that several radical alternatives to the conventional process have been proposed, and in some cases adopted. One solution to the problem is to dissolve a suitable size material in a nonflammable, nonaqueous solvent; for example, a chlorinated hydrocarbon. When warps slashed with such a solution are dried, the evaporated solvent must be recovered, for economy's sake and also to prevent air pollution. Then after weaving, fabric must be desized in the solvent, again requiring an expensive solvent recovery system. Finally, solvent must be reclaimed from the desize liquor by distillation, which step requires a large energy input.

Another approach to the problem involves using polyvinyl alcohol (PVA) dissolved in water. PVA in the desize wash liquor may be reclaimed for recycling. However, the reclamation step requires ultrafiltration, or reverse osmosis, an expensive and delicate process. Even though such reclamation plants cost millions of dollars, the disposal problem is so acute that several ultra-filtration plants are now in use.

The textile industry therefore needs a warp sizing process which will provide a suitable warp size, soluble in water, which can be recovered for recycling from the desizing wash liquor without the requirement of large amounts of energy, and without complex expensive process equipment.

SUMMARY OF THE INVENTION

An object of the invention is to provide a method for sizing textile warps with a water-soluble size which can be reclaimed from desizing liquor by changing the temperature of the desizing liquor.

Another object of the invention is to provide a textile warp size composition which, when dissolved in water, will enable reclamation of the size by changing the temperature of desize liquor and thereby forming a readily separable precipitate of the size.

These objects, and others which will be apparent to those skilled in the art of textile warp sizing, are obtained by using for a warp size a chemical which is soluble in water at one temperature and insoluble in water at a different temperature; and further by providing a process for changing the temperature of desize liquor to precipitate the chemical. One class of chemical compounds useful for the attainment of these objects comprises the hydroxypropylated polysaccharides.

A particularly useful hydroxypropylated polysaccharide is hydroxypropyl cellulose (HPC). HPC is soluble in cold water, making a viscous solution which forms an excellent warp size. Furthermore, HPC can be readily precipitated from desize wash liquor and recovered, simply by heating the desize liquor to 110° F and separating out the precipitated HPC. The supernatant liquor from which the HPC has been reclaimed may be recycled or discharged with a minimum of waste water, because it is essentially free of BOD.

BRIEF DESCRIPTION OF THE DRAWINGS

FIG. 2 is a molecular diagram of a cellulosic saccharide unit in which a 2° hydroxypropylether radical has replaced one of the three hydroxyl groups.

FIGS. 3A, 3B and 3C are graphs comparing performance of different warp sizes.

DESCRIPTION OF THE PREFERRED EMBODIMENTS

Figure 1:
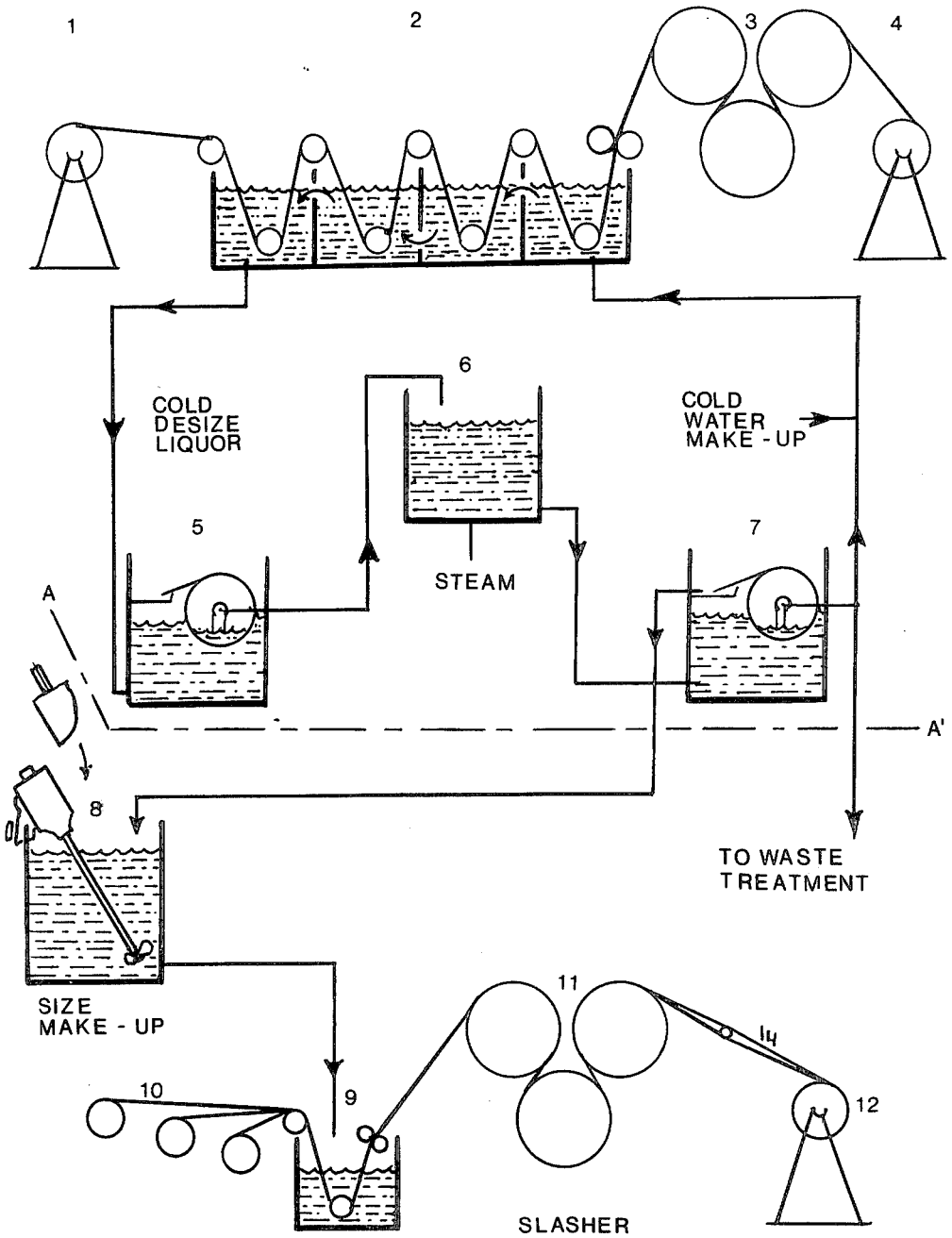
FIG. 1 is a diagrammatic flow sheet of a process for desizing woven fabrics and reclaiming the warp size therefrom for recycle and reuse.

The embodiments described are exemplary of the invention only, and are not to be construed as limiting the invention as defined in the claims.

The hydroxypropylated polysaccharides (HPPS) have the peculiar property of dissolving in cold water, but in hot water, of precipitating from solution in a readily separable floc. HPPS also have excellent warp-sizing properties when coated on textile fibers and dried. In one embodiment illustrative of the invention, hydroxypropyl guar gum is used as a warp size. In another embodiment, hydroxypropyl starch is used.

The preferred HPPS is hydroxypropyl cellulose (HPC). HPC is marketed in several grades according to hydroxypropyl content and molecular weight. HPC suitable for warp size has molecular substitution giving products of from 20% to 80% by weight of hydroxypropoxyl content. A preferred grade of HPC manufactured by Hercules, Inc. is known in the trade as Klucel J(TM). It has an hydroxypropoxyl content of about 73% and a molecular weight of about 200,000.

It is convenient to add to the warp size lubricants which are known to textile chemists to be useful adjuncts to a warp size. A preferred warp size formulation is the following:

Hydroxypropyl cellulose Hercules Klucel J: 125 lb.
Hydrophobic Lubricant: 5 lb.

Referring now to FIG. 1, the process will be described starting with the step of desizing woven fabric. The desizing step is conventional, except that the water used is kept at a temperature below 100° F. Preferably the water should be between 40° F and 80° F. 1 represents a roll of fabric to be desized. The fabric is led over rollers through the desizing tub 2, thence over dryers 3, and is rewound on mandrel 4.

Water level in the desizing tub is maintained by adding cold water at one end. Desize liquor—that is, water in which HPC, washed out of the fabric, has been dissolved — is drawn off at the other end of the tub, at a rate which will maintain the concentration of HPC in the desize liquor at between 0.5% and 1.5%. Flow through the tub, which is compartmentalized, is counter-current to the direction of the fabric's motion.

The desize liquor is then put through a continuous drum filter 5, where particulate matter, such as fibers from the washed fabric, are removed.

In the next step the desize liquor is heated and the HPC precipitated in the form of a floc. Subsequent separation of the HPC is facilitated if the floc is coagulated by addition of an electrolyte such as sodium chloride at this point or into the desize washer or the size formulation. A preferred method of heating the desize liquor is to inject live steam into a vessel 6 containing the liquor until a temperature greater than 110° F is attained. In another embodiment the desize liquor is heated in a heat exchanger.

In the next step, a dispersion of precipitated HPC in water is separated from the desize liquor. The floc which forms when a solution of HPC is heated traps considerable water with it. Since the precipitated HPC is to be recycled as concentrated warp size solution, it is neither necessary nor desirable to completely separate HPC solids from trapped water. What is needed is a concentration of about 3 - 10% HPC in water. This is achieved by passing the hot desize liquor through a filtration medium such as nylon fabric. The Dual Cell Gravity dewatering unit of Permutit Company, division of Sybron Corporation 7 represents such a unit.

In anotherembodiment the hot desize liquor is kept in the tanks in which it was heated until the floculated HPC has settled, after which it is decanted and the supernatant water is discarded or recycled. In yet another embodiment the precipitated HPC is separated by passing the hot desize liquor through a centrifugal separator such as the type used to separate starch from gluten in corn refining.

The concentrated dispersion of precipitated HPC and water is turbid and free-flowing as long as its temperature is kept above 110° F. As the dispersion cools, the HPC begins to dissolve in the water. The solution will clarify and become viscous. It is important therefore to avoid stagnant volumes in the piping which conducts warm concentrated HPC dispersion where cooling could cause local plugging.

The warm, concentrated dispersion of HPC is pumped into make-up tank 8 for making a new supply of warp size. It is convenient, at this point, to add sufficient fresh HPC, or cold water, to bring the warp size composition to the required concentration. Finally the batch is agitated to speed solution of the HPC.

The freshly made batch of warp size is pumped into the slasher size box 9. Temperature must be below 100° F, and is preferably between 70° F and 90° F. Since viscosity and therefore pick-up by the warp threads varies with temperature, close attention is required.

The warp, wound on warp beams 10, is led through the size box of the slasher in conventional manner, passes over drying rolls 11 and is rewound on loom beam 12. The loom beam may be stored or even transported to another location for the weaving step.

In many cases, the steps of slashing and of weaving and desizing are physically separated in different plants. In these cases the process can be separated between the two plants along the line A—A'. When this is done, the reclaimed HPC is shipped from the desizing plant to the plant in which the warp yarns are slashed.

The following experiments were made to establish the effectiveness of HPC as a warp size:

Experiment #1

The effectiveness of an aqueous solution of HPC as a warp size was compared with the effectiveness of an aqueous solution of polyvinyl alcohol (PVA). PVA is known to be one of the most effective warp sizes known to the art, although it is expensive relative to more common warp sizes such as the starches. Comparison was made of laboratory sized yarns at different add-on precentages of size. Samples were evaluated in terms of parameters standard in the art. Results are shown in graphical form in FIGS. 3A, 3B and 3C. In FIG. 3A, percentage increase in breaking strength over unsized cotton yarns is plotted against add-on percent (by weight of yarn) for HPC and PVA. In FIG. 3B, percent decrease in elongation is similarly plotted. The yarns must retain a certain minimum level of elongation to weave efficiently. In FIG. 3C, abrasion resistance is similarly plotted. (PVA has superior abrasion resistance because a sizing lubricant is required for its use.)

The graphs of FIGS. 3A, 3B and 3C show that HPC is the equivalent of PVA in effectiveness as a warp size on 100% cotton yarns. Of course, when the warp size is recovered and recycled the use of high add-on percentages is far less objectionable than it is when the warp size must be discarded.

Experiment #2

The tables below show the effect of HPC compared to the effect of PVA as a warp size when it is applied to yarns of 50% polyester and 50% cotton. The tables again show that HPC is generally the equivalent of PVA as a warp size.

TABLE 1

| Sample | Percent Size add-on | Mean Break Factor (oz. x counts) | Percent increase in tenacity over unsized control |
|---|---|---|---|
| Control | - 0 - | 363 | — |
| PVA* | 7.0 | 384 | 6 |
| HPC | 13.8 | 426 | 18 |

*Griffwax(TM) sizing lubricant, 5% on weight of the PVA, was added to the PVA size formulation.

TABLE 2

| Sample | Percent Size add-on | Mean Elongation at Break | % decrease in elongation from unsized control |
|---|---|---|---|
| Control | - 0 - | 11.2 | — |
| PVA* | 7.0 | 7.9 | 30 |
| HPC | 13.8 | 8.1 | 28 |

*Griffwax(TM) sizing lubricant, 5% on weight of the PVA, was added to the PVA size formulation.

TABLE 3

| Sample | Percent Size add-on | Mean Abrasion Resistance (cycles to break) |
|---|---|---|
| Control | - 0 - | 67 |
| PVA* | 7.0 | 10,000+ |
| HPC | 13.8 | 5,491 |

*Griffwax(TM) sizing lubricant, 5% on weight of the PVA, was added to the PVA size formulation.

Experiment #3

HPC was recovered from sized yarns, reprecipitated, and re-used as a warp size. Tensile strength, elongation, and abrasion resistance were the same for the reclaimed as for the virgin HPC.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. A process for sizing and desizing textile yarns which comprise the steps of (a) dissolving a chemical which is soluble in water at one temperature and insoluble in water at a different temperature, the chemical being capable of forming a warp size in water to make an effective sizing solution;

(b) sizing textile yarns with the solution;

(c) weaving the sized yarns into a fabric;

(d) desizing the fabric by contacting the fabric with water at a temperature which will dissolve out the chemical, thereby making a desize liquor;

(e) changing the temperature of the desize liquor to precipitate a dispersion of the chemical;

(f) separating the dispersion of precipitated chemical from supernatant water;

(g) changing the temperature of the dispersion to make a solution of the chemical, and (h) adjusting solids content of the solution as required to make a sizing solution.

2. The process of claim 1 in which the chemical used is an hydroxypropylated polysaccharide characterized by a hydroxypropyl content of from 20% to 85% by weight of the hydroxypropylated polysaccharide, and an average molecular weight of from 20,000 to 1,500,000.

3. The process of claim 1 in which the weight of percent of hydroxypropylated saccharide based on sized yarn in step (c) is between 1% and 25%.

4. The process of claim 2, comprising the further step of adding to the desize liquor of step (d), a quantity of a salt effective in promoting coagulation of precipitated hydroxypropylated polysaccharide, the salt being chosen from the group which consists of sodium chloride, sodium sulfate, calcium chloride, and aluminum sulfate.

5. A composition of matter useful for making a reclaimable textile warp size which comprises an hydroxypropylated polysaccharide, and a salt selected from the group consisting of sodium chloride, sodium sulfate, calcium chloride and aluminum sulfate.

6. A process for sizing and desizing textile yarns which comprises the steps of (a) dissolving, in cold water, hydroxypropyl cellulose having a hydroxypropoxyl content of from 20% to 85% by weight of the hydroxypropyl cellulose, (b) sizing textile yarns with the solution to add to the textile fibers from 1% to 25% by weight of dry hydroxypropyl cellulose based on the dry weight of the sized yarn.

(c) weaving the sized yarns into a fabric, (d) desizing the fabric by contacting the fabric with water at a temperature less than 100° F to dissolve out the hydroxypropyl cellulose, thereby making a desize liquor;

(e) heating the desize liquor to a temperature above 110° F to precipitate a dispersion of hydroxypropyl cellulose;

(f) separating from supernatant water a dispersion of precipitated hydroxypropyl cellulose of from 4% to 75% solid hydroxypropyl cellulose by weight based on the weight of the dispersion;

(g) cooling the dispersion below 100° F to make a solution of hydroxypropyl cellulose; and (h) adjusting solids content of the solution as required to make a sizing solution suitable for use in step (a).

* * * * *